United States Patent [19]

Marshall

[11] 4,431,166

[45] Feb. 14, 1984

[54] GARBAGE CAN MAT

[76] Inventor: Richard W. Marshall, 1518 Nakula St. Wahiawa, Hi. 96786

[21] Appl. No.: 319,736

[22] Filed: Nov. 9, 1981

[51] Int. Cl.[3] ..... E04H 17/00

[52] U.S. Cl. ..... 256/1; 256/14

[58] Field of Search ..... 256/14, 18, 17, 1; 404/35; 15/238; 272/56.5 SS

[56] References Cited

U.S. PATENT DOCUMENTS

| | | | |
|---|---|---|---|
| 594,050 | 11/1897 | Wiggs | 256/14 |
| 662,597 | 11/1900 | Jackson | 256/14 |
| 719,509 | 2/1903 | Rimbey | 256/14 |
| 915,975 | 3/1909 | Lillegren | 256/1 |
| 1,048,330 | 12/1912 | Martin | 256/17 |
| 2,297,193 | 9/1942 | Silverman | 248/146 |
| 2,596,541 | 5/1952 | Farquharson | 211/71 GC |
| 2,680,698 | 6/1954 | Schnee | 404/35 |
| 2,924,455 | 2/1960 | Brunel | 404/35 X |
| 3,406,617 | 10/1968 | Randazzo | 272/56.5 SS |
| 3,694,983 | 10/1972 | Couquet | 272/56.5 SS |
| 4,179,539 | 12/1979 | Schweizer | 272/56.5 SS X |

FOREIGN PATENT DOCUMENTS

| | | | |
|---|---|---|---|
| 322224 | 12/1929 | United Kingdom | 256/1 |

*Primary Examiner*—Andrew V. Kundrat

*Attorney, Agent, or Firm*—George W. T. Loo

[57] ABSTRACT

A garbage can mat which encloses a garbage can or cans and acts as a barrier for dogs to prevent them from knocking over the garbage can or cans. The mat includes modules which are snap-fastened together at their adjoining end portions to form an enclosure. Each module has a male end portion, a middle portion, and a female end portion. The male end portion has a L-shaped recess and at least two spaced pins projecting downwardly from a ledge. The middle portion has spaced rounded spikes projecting upward. The female end portion has a L-shaped recess and at least two spaced holes in a ledge. The pins of the male end portion are designed to be snap-fitted into corresponding holes in the ledge of a female end portion of an adjoining module to provide a positive connection and yet to disconnected conveniently when desired. A curved section module and a straight section module are used. The curved section module has a 90° arc. For a round configuration four curved section modules are snap-fastened together. For an oval configuration, the round configuration is expanded at its middle by the addition of two straight section modules in spaced parallel relationship to each other, between two joined curved section modules.

3 Claims, 10 Drawing Figures

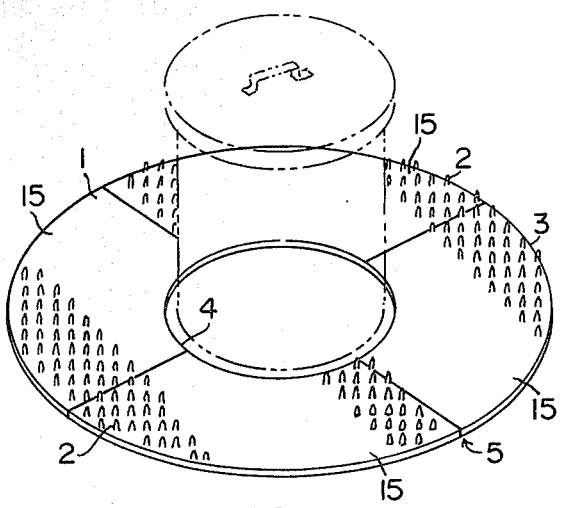
FIG. 1
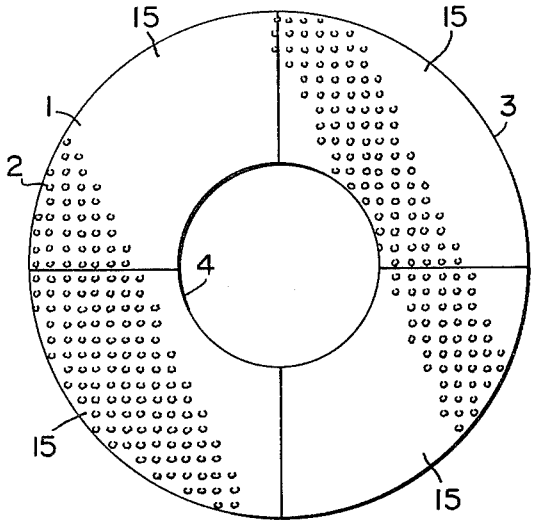
FIG. 2
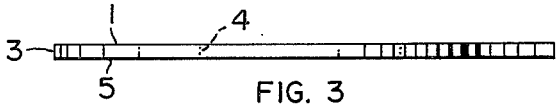
FIG. 3
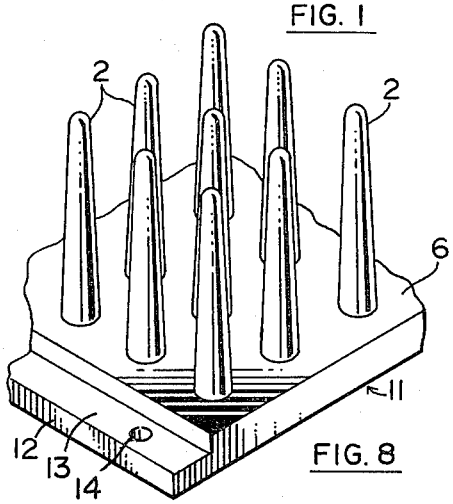
FIG. 8
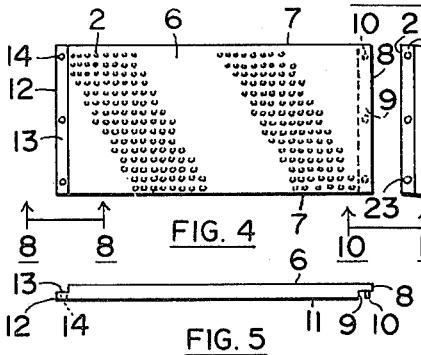
FIG. 4
FIG. 5
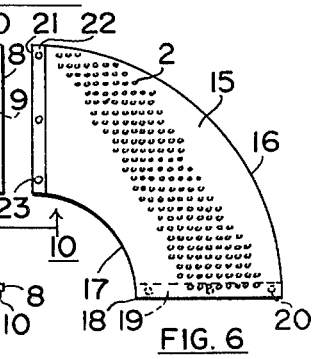
FIG. 6
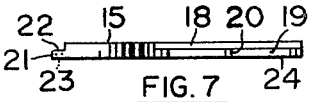
FIG. 7
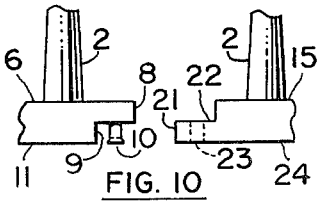
FIG. 10
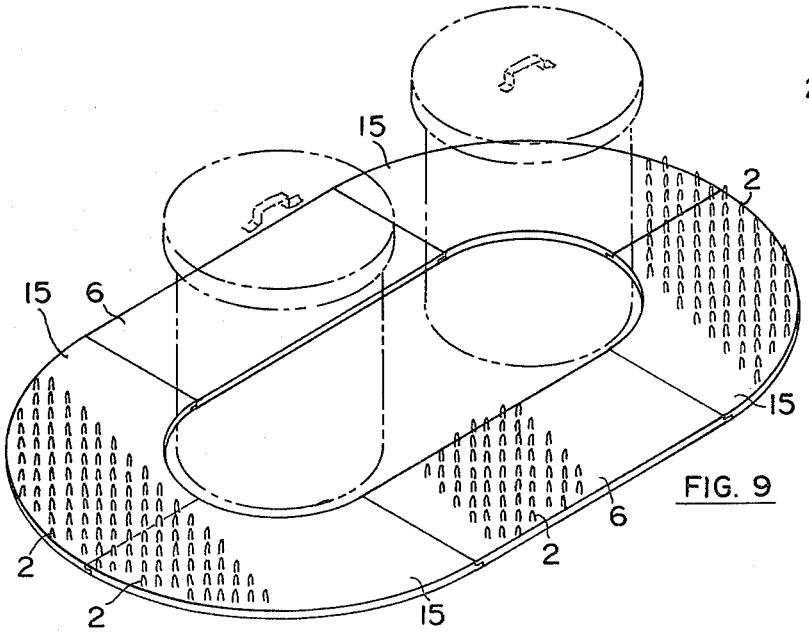
FIG. 9

GARBAGE CAN MAT

BACKGROUND OF THE INVENTION

1. Field of the Invention

This invention relates to a garbage can mat which will keep dogs from knocking over the garbage can or cans.

2. Description of the Prior Art

Present garbage can holders use frames or elevation to prevent dogs from knocking over the garbage can. See Silverman, U.S. Pat. No. 2,297,193, dated Sept. 29, 1942 and Farquharson, U.S. Pat. No. 2,596,541, dated May 13, 1962.

My invention is intended to be placed around a garbage can or cans that are to be protected and to act as a barrier for dogs, not to support the garbage can or cans as in the prior art. While present garbage can holders which prevent dogs from knocking over garbage cans are expensive to manufacture and difficult to install, my invention is inexpensive to manufacture and easy to install.

Disclosure Statement

Silverman discloses a garbage can holder with a square base casting and a detachable wire frame. The base casting has a moat in which a liquid is poured to keep ants from a garbage can which is placed on an elevated flat surface inside of the moat. The wire frame has uprights which fit snugly into holes in the periphery of the surface and the frame as a whole keeps dogs from knocking the garbage can over.

Farquharson discloses a garbage can holder which uses elevation to make the garbage can inaccessible to domestic animals or rodents. A garbage can supporting frame is secured to a spindle which is rotatably mounted to a tubular post that is anchored to or embedded in the ground surface.

My invention includes spiked mat ring modules which are snap-fastened together to form an enclosing barrier for a garbage can or cans. Semi-rigid spikes prevent dogs from knocking over the garbage can or cans. The modules are made of a curved section and of a straight section.

SUMMARY OF THE INVENTION

This invention relates to a garbage can mat which will prevent dogs from knocking over the garbage can or cans. The invention includes spiked mat ring modules which are snap-fastened together to form an enclosing barrier for a garbage can or cans, to protect the can or cans from dogs. The modules are made straight and curved.

An object of this invention is to provide a garbage can mat which will prevent dogs from knocking over an enclosed garbage can or cans.

Another object of this invention is to provide a garbage can mat which is constructed in a modular manner.

A further object of this invention is to provide a garbage can mat which is inexpensive to manufacture and easy to install.

Still another object of this invention is to provide a garbage can mat which will function properly on any surface capable of supporting a garbage can.

A still further object of this invention is to provide a garbage can mat which will be easy to maintain.

Another object of this invention is to provide a garbage can mat which includes modules that are snap-fastened together to form a surrounding barrier for the protection of a garbage can or cans.

A further object of this invention is to provide a garbage can mat which can be readily expanded to protect more than one garbage can.

Still another object of this invention is to provide a garbage can mat which is durable, inexpensive, light in weight, and safe.

A still further object of this invention is to provide a garbage can mat which is pleasing in appearance.

Another object of this invention is to provide a garbage can mat which can be easily disassembled and stored.

A further object of this invention is to provide a garbage can mat which can be easily picked up and moved to another suitable location.

A still further object of this invention is to provide a garbage can mat which encloses a garbage can or cans and acts as a barrier for dogs to prevent them from knocking over the garbage can or cans.

Other objects, features and advantages of the present invention will be readily apparent from the following detailed description taken in connection with the accompanying drawing.

BRIEF DESCRIPTION OF THE DRAWING

FIG. 1 is a perspective view of a garbage can mat of round configuration with a garbage can shown in broken lines.

FIG. 2 is a top view of the garbage can mat of round configuration.

FIG. 3 is a front view of a whole garbage can mat, without the spikes.

FIG. 4 is a top view of a straight section module of a garbage can mat.

FIG. 5 is a front view of a straight section module of a garbage can mat shown in FIG. 4, without the spikes.

FIG. 6 is a top view of a curved section module of a garbage can mat.

FIG. 7 is a front view of a curved section of a garbage can mat shown in FIG. 6, without the spikes.

FIG. 8 is an enlarged fragmentary perspective view of module showing the spike detail, looking in the direction of line 8—8 of FIG. 4.

FIG. 9 is a perspective view of a garbage can mat of oval configuration with two garbage cans shown in broken lines.

FIG. 10 is an enlarged fragmentary front view of two modules showing the snap-fastening element detail between adjoining sections, looking in the direction of line 10—10 of FIGS. 4 and 6.

DESCRIPTION OF THE PREFERRED EMBODIMENT

Before explaining the present invention in detail it is to be understood that the invention is not limited in its application to the details of construction and arrangements of parts illustrated in the accompanying drawing, since the invention is capable of other embodiments and of being practiced or carried out in various ways. Also, it is to be understood that the phraseology and terminology employed herein is for the purpose of description and not of limitation.

Referring now to the drawing wherein like reference numerals refer to like and corresponding parts throughout the several views, the preferred embodiment of the invention is disclosed in FIGS. 1–10 inclusive. My invention includes modules which are snap-fastened together at their adjoining end portions to form a round or oval configuration.

The round configuration 1, shown in FIGS. 1–3, includes spikes 2, a base 3, an opening 4, and a bottom 5. Spikes 2 project upward from base 3. Round configuration 1 is composed of four curved section modules 15 which are snap-fastened together at their adjoining end portions.

Curved section module 15 includes spikes 2, outside border 16, inside border 17, male end portion 18, female end portion 21, and bottom 24. A middle portion is defined by outside border 16, inside border 17, male end portion 18, and female end portion 21. Spikes 2 project upward from the middle portion and may also project upward from male end portion if it is desirable to do so. Male end portion 18 includes a L-shaped recess 19 and spaced pins 20. Female end portion 21 includes a L-shaped recess 22 and spaced holes 23. Corresponding pins 20 are designed to be snap-fastened within corresponding holes in an adjoining module to lock the two modules together to form a larger mat area and yet to unlock conveniently when desired.

The round configuration 1 may be expanded to an oval configuration by the addition of two straight section modules 6, in spaced parallel relationship to each other, at the middle of the round configuration 1 between two joined curved section modules 15. See FIG. 9. In the event that more than two garbage cans are to be protected, additional pairs of straight section modules 6 are added as needed.

Straight section 6 includes spikes 2, two sides 7, a male end portion 8, a female end portion 11, and a bottom 11. A middle portion is defined by sides 7, male end portion 8, and female end portion 11. Spikes 2 project upward from the middle portion and may project upward from male end portion if it is desirable to do so. Male end portion 8 includes a L-shaped recess 9 and spaced pins 10 which project downwardly from a ledge. Female end portion 12 includes a L-shaped recess 13 and spaced holes 14 in a ledge. Pins 10 are designed to be snap-fastened within corresponding holes in an adjoining module to lock the two modules together to form a larger mat area and yet to unlock conveniently when desired. Straight section modules 6 are used when protection for two or more garbage cans are needed by adding pairs of straight section modules as needed between the two joined curved section modules 15.

My invention is based on the knowledge that the area between a dog's paw is soft and very tender and that a dog will avoid surfaces which pose a threat to this area. In order for a dog to tip a garbage can over, it is necessary for the dog to place its front paws high enough on the garbage can to overcome the center of gravity of the garbage can and to place his full weight on his back paws. If a dog were to do so with a garbage can protected by my invention, the spikes of the garbage can mat would be driven between the dog's pads and cause the dog great pain. However, a dog will not allow himself into such a position in the first place as a dog will take a look at my garbage can mat, walk around it while looking for an opening and finding no opening will go to a garbage can not so protected.

My invention includes modules which are installed by snap-fastening adjoining modules together to form the desired mat area. The modules are made of a semi-rigid plastic or rubber-based material, grass-green in color, by the injection molding process.

The cost of manufacture of my invention is inexpensive since only two types of modules are made, a curved section module and a straight section module. The curved section module is 90° of a circle. Four curved section modules are needed to form a complete circle when their adjoining end portions are snapped together as shown in FIGS. 1 and 2. A garbage can placed within opening 4 in FIG. 1 is protected from being knocked over by dogs.

The dimensions for a garbage can mat of round configuration are inside diameter of 16 inches, outside diameter of 40 inches, base of mat is $\frac{1}{4}$ inch thick. Spikes are $1\frac{1}{2}$ inches high from base of mat, $\frac{1}{4}$ inch in diameter at its base, tapering to $\frac{1}{8}$ inch and rounded at the top. Spikes are placed 1 inch apart, on center, over the entire mat area. Recesses are approximately 1 inch long and $\frac{1}{8}$ inch high. Three pins and three holes of approximately 3/32 inch in diameter are used. The area is approximately $8\frac{1}{2}$ square feet.

The dimensions of a straight section module are 27 inches long and $\frac{1}{4}$ inch thick. L-shaped recesses are 1 inch long and $\frac{1}{8}$ inch high. Three pins and three holes are used. The pins and holes each have a diameter of approximately 3/32 inch so as to insure a close fit when the pins are snap-fitted into the holes of an adjoining module.

Use of pins and corresponding holes reduce the cost of production of the mat and yet provide a positive lock which can be conveniently disconnected when desired. The pins are somewhat flexible and resilient and will yield slightly to allow the pins to slide into the holes for a close fit.

With oversized garbage cans, the inside diameter of the mat must be slightly greater than the diameter of the garbage can to be enclosed at its base. I found that a barrier of 24 inches is preferable. Thus for oversized garbage cans, it may become expedient to manufacture a mat larger in diameter, say 48 inches, in order to present the same amount of barrier to the dog.

The operation of my invention is as follows: (1) Determine the number and kind of mat modules needed to protect the garbage can or cans. (2) Assemble the modules in the order of installation. (3) Snap-fastened the adjoining modules together to form an enclosing barrier for the garbage can or cans. (4) Place the installed garbage can mat so that the garbage can or cans are within the opening and so that the spikes project upward. My invention is now ready to protect the garbage can or cans.

Features of my invention are as follow: (1) With proper care it will last a long time since it is not subject to deterioration by the elements. Maintenance consists of an occasional rinsing with a garden hose. (2) It is inexpensive to manufacture as only two different modules are made. (3) It will be cheap enough in cost so that its theft will not represent a problem. (4) The mat for the protection of one garbage can will weigh approximately two pounds so that it can easily be handled by the most frail of women. (5) The mat is safe as no injury to children or adults will result from their walking or falling on it as there are no sharp edges or projections and as it is soft enough to yield somewhat, yet rigid enough to perform its purpose. (6) The mat may be picked up and moved to any suitable location at any time. (7) It will function properly on any surface capable of supporting a garbage can. (8) The mat will function when a garbage can is placed next to a wall or fence so long as all areas of approach are still guarded. (9) The mat may be stored by rolling and tieing with twine or left flat, whichever is suitable. (10) The mat may be used as a shock absorber when shipping a crate or box of dishes or other fragile material. (11) The mat will eliminate any physical interference to sanitation crews with garbage can or cans pick up. (12) The mat will save the home owner the odious chore of cleaning up the mess caused by dogs tipping over the garbage can. (13) Dogs will instrictively avoid my mat in order to protect the soft and tender area between pads in their paws. (14) It is entirely nontoxic to handle.

I have chosen to make my invention of a round or oval configuration as it is more appealing than a square or rectangular configuration and requires less area. However, other configurations may be used if desired.

I have chosen to make my invention of a grass-green color so that it will tend to blend with the background. However, other colors may be used if desired.

I have chosen a spiked design for my invention because of the inexpensive cost of manufacture. However, other designs which will accomplish the purpose of protecting garbage cans from being knocked over by dogs may be used if the cost of manufacture is lower or if desired.

If desired, an insecticide may be added to the material as is done with currency to discourage insect infestation.

In summary, I have invented a durable, inexpensive, light in weight, safe, and pleasing in appearance garbage can mat. The mat will enclose a garbage can or cans and will act as a barrier for dogs to prevent them from knocking over the garbage can or cans. The mat includes modules which are installed by snap-fastening adjoining modules together to form the desired mat area.

Although but a single embodiment of the invention has been disclosed and described herein, it is obvious that many changes may be made in the size, shape, arrangements, color and detail of the various elements of the invention without departing from the scope of the novel concepts of the present invention.

I claim as my invention:

1. A garbage can mat comprising a module which includes a male end portion, a middle portion, and a female end portion; means to prevent dogs from knocking over a garbage can which includes spaced rounded spikes projecting from the middle portion; and means to snap-fasten adjoining modules together to provide a positive lock and yet to unlock conveniently when desired which includes a L-shaped recess in the male end portion and at least two spaced pins projecting from a ledge of the male end portion and a L-shaped recess in the female end portion and at least two spaced holes in a ledge of the female end portion; the pins closely fit within corresponding holes of an adjoining module; the inner and outer borders of the module are curved and have a 90° arc; in combination with three other identical modules, the four modules are snap-fastened together to form a round configuration, whose inside circumference is slightly greater than the circumference of a garbage can to be protected.

2. A garbage can mat comprising a module which includes a male end portion, a middle portion, and a female end portion; means to prevent dogs from knocking over a garbage can which includes spaced rounded spikes projecting from the middle portion; and means to snap-fasten adjoining modules together to provide a positive lock and yet to unlock conveniently when desired which includes a L-shaped recess in the male end portion and at least two spaced pins projecting from a ledge of the male end portion and a L-shaped recess in the female end portion and at least two spaced holes in a ledge of the female end portion; the pins closely fit within corresponding holes of an adjoining module; wherein there are six modules, four modules have inner and outer borders which are curved and have a 90° arc and two modules have inner and outer borders which are straight and equal in length; the four curved modules and two straight modules are snap-fastened together so that the two straight mat modules will be in a spaced parallel relationship and the inside circumference of the enclosure formed by the modules is capable of having two garbage cans within the inside circumference.

3. The garbage can mat of claim 2, wherein additional pairs of straight modules are used when the protection of more than two garbage cans is required.

* * * * *